US007543445B2

(12) United States Patent
Bardasz

(10) Patent No.: US 7,543,445 B2
(45) Date of Patent: Jun. 9, 2009

(54) METHODS FOR REGENERATION AND PERFORMANCE OF A PARTICULATE FILTER OF AN INTERNAL COMBUSTION ENGINE

(75) Inventor: Ewa Bardasz, Mentor, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 10/968,201

(22) Filed: Oct. 19, 2004

(65) Prior Publication Data

US 2006/0080954 A1 Apr. 20, 2006

(51) Int. Cl.
*F01N 3/00* (2006.01)

(52) U.S. Cl. ..... 60/295; 60/273; 60/274; 60/297; 60/311; 44/359; 44/366; 44/375; 44/402; 44/438; 508/193; 508/291; 508/294; 508/298; 508/375

(58) Field of Classification Search ..... 60/273, 60/274, 278, 295, 297, 311; 44/358, 359, 44/366, 375, 402, 438, 640; 508/192, 193, 508/291, 294, 298, 371, 375, 460
See application file for complete search history.

(56) References Cited

U.S. PATENT DOCUMENTS

| | | | | | |
|---|---|---|---|---|---|
| 4,946,609 | A | | 8/1990 | Pruess et al. | 252/35 |
| 4,952,328 | A | * | 8/1990 | Davis et al. | 508/237 |
| 5,344,467 | A | | 9/1994 | Huang et al. | |
| 5,522,905 | A | | 6/1996 | Krutzsch et al. | |
| 5,525,247 | A | * | 6/1996 | Miyaji et al. | 508/192 |
| 5,562,742 | A | | 10/1996 | Kolp et al. | |
| 5,672,570 | A | * | 9/1997 | Miyaji et al. | 508/192 |
| 5,912,190 | A | | 6/1999 | Barr et al. | |
| 6,003,303 | A | * | 12/1999 | Peter-Hoblyn et al. | 60/274 |
| 6,056,792 | A | | 5/2000 | Barr et al. | |
| 6,074,444 | A | * | 6/2000 | Bingley | 44/320 |
| 6,725,653 | B2 | * | 4/2004 | Brown et al. | 60/297 |
| 6,759,375 | B2 | * | 7/2004 | Curtis et al. | 508/551 |
| 6,784,143 | B2 | * | 8/2004 | Locke et al. | 508/460 |
| 6,892,531 | B2 | * | 5/2005 | Rim | 60/295 |

FOREIGN PATENT DOCUMENTS

| | | | |
|---|---|---|---|
| DE | 4133137 | A1 | 4/1992 |
| EP | 1362905 | A1 | 11/2003 |
| EP | 1378560 | A2 | 1/2004 |
| GB | 2248068 | A | 3/1992 |
| WO | 00/58422 | A1 | 10/2000 |
| WO | WO 2005/090532 | A1 | 3/2005 |

OTHER PUBLICATIONS

PCT Search Report for corresponding International Application No. PCT/US2005/037144 mailed Jul. 19, 2006.
Corresponding PCT Publication WO 2006/044729A2 published Apr. 27, 2006.
JP2004035652 Abstract, Patent Abstracts of Japan Published May 2, 2004 Cosmo Sekiyu Lubricants KK.

* cited by examiner

*Primary Examiner*—Binh Q. Tran
(74) *Attorney, Agent, or Firm*—Christopher D. Hilker; David M. Shold

(57) ABSTRACT

Methods for regenerating or improving the regeneration of a particulate filter and for improving the performance of a particulate filter during the operation of an internal combustion engine comprise lubricating the engine with a lubricant composition comprising additives that when combusted can form an ash deposit in the filter. The methods are particularly useful for diesel particulate filters on diesel engines that are equipped with an exhaust gas recirculation system.

13 Claims, No Drawings

METHODS FOR REGENERATION AND PERFORMANCE OF A PARTICULATE FILTER OF AN INTERNAL COMBUSTION ENGINE

BACKGROUND OF THE INVENTION

1. Field of the Invention

The present invention involves methods for regeneration and performance of a particulate filter of an internal combustion engine, especially a particulate filter of a compression-ignited internal combustion engine which is also termed a diesel engine.

2. Description of the Related Art

Exhaust emissions, to include particulate matter such as soot, of internal combustion engines are being reduced due to governmental regulations for health and environmental concerns. Particulate matter can be reduced in diesel engines by placing a diesel particulate filter in the exhaust system of the engine. The buildup of particulate matter in a particulate filter needs to be oxidized or combusted at regular intervals in a controlled process to keep engine back pressure low so that the engine operates efficiently and to avoid the release over a short period of time of large amounts of heat from soot combustion so that the particulate filter is not thermally damaged. Methods of regenerating a particulate filter by combustion of the accumulated particulate matter such as soot in a controlled process include a) systems that periodically raise the temperature of the exhaust emissions from the engine or the temperature of the particulate filter or b) using a particulate filter that contains a catalyst, such as an oxide of cerium or vanadium, to reduce the ignition temperature for combustion of particulate matter where the catalyst is added to the filter during its manufacture or introduced to the filter from a fuel during engine operation. Diesel engines, to include heavy duty diesel engines, are being equipped with an exhaust gas recirculation (EGR) system to meet governmental regulations for reduced emissions of nitrogen oxides or $NO_x$. The inclusion of an EGR system on a diesel engine results in increased emissions of soot from the engine into the exhaust system and puts an increased burden on a diesel particulate filter to function efficiently in controlling/preventing tailpipe soot emissions. The presence of engine lubricant derived ash in a particulate filter has generally been considered to be deleterious to the performance of the filter. The engine lubricant derived ash can result from the combustion of metal and/or boron containing additives present in an engine oil that enter the combustion chamber and form a metal and/or boron containing ash deposit in the filter.

Huang et al. in U.S. Pat. Nos. 5,344,467 and 5,562,742 disclose organometallic complexes that can be used in diesel fuels for operating diesel engines equipped with exhaust system particulate traps.

Krutzsch et al. in U.S. Pat. No. 5,522,905 disclose a diesel fuel that contains an additive which improves the combustion of soot.

Barr et al. in U.S. Pat. Nos. 5,912,190 and 6,056,792 disclose a process of improving combustion of fuel and/or improving oxidation of carbonaceous products derived from the combustion of the fuel by including in the fuel prior to its combustion a Group I and/or Group II organo-metallic complex.

Caprotti et al. in International Publication No. WO 00/58422 disclose a fuel oil composition that comprises a) a neutral alkaline earth metal compound and/or a neutral alkali metal compound and b) a transition metal compound.

Roos et al. in European Publication No. EP 1378560A2 disclose aqueous additives in hydrocarbonaceous fuel combustion systems where the aqueous additive comprises one or more inorganic or organic metal compounds to include alkali, alkaline earth and transition metal compounds.

Methods for regeneration and performance of a particulate filter, especially a diesel particulate filter, have now been found that unexpectedly comprise lubricating an internal combustion engine with a lubricant composition that comprises additives that deliver ash to the particulate filter.

SUMMARY OF THE INVENTION

An object of the present invention is to regenerate or improve the regeneration of a diesel particulate filter of a diesel internal combustion engine.

Another object of this invention is to improve the performance of a diesel particulate filter of a diesel internal combustion engine.

Additional objects and advantages of the present invention will be set forth in the Detailed Description which follows and, in part, will be obvious from the Detailed Description or may be learned by the practice of the invention. The objects and advantages of the invention may be realized by means of the instrumentalities and combinations pointed out in the appended claims.

To achieve the foregoing objects in accordance with the present invention as described and claimed herein, a method for regenerating or improving the regeneration of a diesel particulate filter during the operation of a diesel engine comprises lubricating the engine with a lubricant composition comprising (A) a major amount of an oil of lubricating viscosity, and (B) a minor amount of at least one overbased metal-containing detergent wherein the detergent is derived from a detergent substrate; the metal of the detergent is an alkali metal, an alkaline earth metal, or a mixture thereof; and the overbased detergent has more than 1 equivalent of metal per equivalent of the detergent substrate.

In another embodiment of the invention, a method for improving the performance of a diesel particulate filter during the operation of a diesel engine comprises lubricating the engine with a lubricant composition comprising (A) a major amount of an oil of lubricating viscosity, (B) a minor amount of at least one overbased metal-containing detergent, (C) at least one zinc dialkyl dithiophosphate, and (D) at least one element-containing organic composition wherein the detergent is derived from a detergent substrate; the metal of the detergent is an alkali metal, an alkaline earth metal, or a mixture thereof; the overbased detergent has more than 1 equivalent of metal per equivalent of the detergent substrate; and the element of component (D) is a group 3 to group 15 element of the Periodic Table of the Elements or a mixture thereof.

DETAILED DESCRIPTION OF THE INVENTION

The method of the present invention for regenerating or improving the regeneration of a diesel particulate filter during the operation of a diesel engine comprises lubricating the engine with a lubricant composition comprising (A) a major amount of an oil of lubricating viscosity, and (B) a minor amount of at least one overbased metal-containing detergent wherein the detergent is derived from a detergent substrate; the metal of the detergent is an alkali metal, an alkaline earth metal, or a mixture thereof; and the overbased detergent has more than 1 equivalent of metal per equivalent of the detergent substrate. In an embodiment of the invention lubricant composition normally enters the combustion chamber during lubrication of the diesel engine and results in ash depositing in the diesel particulate filter from combustion of additives present in the lubricant composition such as for example overbased metal-containing detergents. In another embodiment of the invention the lubricant composition entering the combustion chamber is increased over the lubricant composition normally entering the combustion chamber due to lubrication of the engine by means of an on board dosing device such as for example a mist generator that introduces lubricant composition as a mist into an air intake manifold of the engine.

Diesel Particulate Filter

The diesel particulate filter can be any type of thermally stable filtering device capable of removing particulate matter such as soot from the engine exhaust stream. The diesel particulate filter or particulate filter or filter is placed downstream from the engine in the engine exhaust system, and is normally placed close to where the engine exhaust stream exits the engine. The filter can be made of various types of thermally stable materials including ceramic materials such as a cordierite or a silicon carbide and includes filters that are porous ceramic wall-flow monoliths. The particulate filter can be an uncatalyzed filter or a catalyzed filter. A catalyzed filter can be produced by treating an uncatalyzed filter with one or more metals or metal compounds and the treatment normally results in a calcined coating of one or more metals and/or metal oxides that can lower the temperature of combustion of particulate matter such as soot. Catalyzed filters can be obtained from a filter manufacturer or by installing an uncatalyzed filter in the exhaust system of an internal combustion engine and operating the engine with a fuel containing metal additives that can form a catalytic coating on the filter.

Oil of Lubricating Viscosity

The lubricant composition of the present invention can comprise (A) a major amount of an oil of lubricating viscosity where a major amount can be greater than 50% by weight. The oil of lubricating viscosity can have a kinematic viscosity in $mm^2/s$ (or centistokes) at 100° C. of 2-70, and in other instances of 3-50, or 4-40. The oil of lubricating viscosity can be a natural oil, a synthetic oil, or a mixture thereof. Natural oils can comprise crude and refined mineral oils derived from petroleum, coal, shale, or a mixture thereof; animal oils; plant or vegetable oils; or a mixture thereof. Synthetic oils can comprise both unhydrogenated and hydrogenated polyolefins, carboxylic acid esters prepared from mono- and/or polycarboxylic acids or reactive equivalents thereof and from mono- and/or polyhydric alcohols, alkylated aromatics, polyglycols and derivatives thereof, phosphate esters, silicone oils, hydrocarbons prepared by a gas to liquid process such as for example a Fischer-Trospsch process, or a mixture thereof. The oil of lubricating viscosity can be a single oil or a mixture of two 2 or more oils. For example the oil of lubricating viscosity can be a natural oil, a synthetic oil, 2 or more natural oils such as 2 refined mineral oils, 2 or more synthetic oils, or a mixture of one or more natural oils and one or more synthetic oils. The oil of lubricating viscosity can include the American Petroleum Institute Group I, II, III, IV and V base oils. In several embodiments of the invention the oil of lubricating viscosity can be present in the lubricant composition on a weight percent basis at greater than 50%, at 55 to 99.9%, at 60 to 99.5%, at 65 to 98%, or at 75 to 95%.

Overbased Metal-Containing Detergent

The lubricant composition of this invention can comprise (B) a minor amount of at least one overbased metal-containing detergent where a minor amount can be less than 50% by weight. In an embodiment of the invention the metal of the detergent can comprise any metal, and in other embodiments the metal can comprise an alkali metal to include for example sodium or lithium or potassium, an alkaline earth metal to include for example calcium or magnesium or barium, or a mixture thereof. The detergent can be oil soluble, oil dispersible, or soluble or dispersible in the lubricant composition. The detergent is usually oil soluble. The detergent can have 8 to 100 carbon atoms, 10 to 90 carbon atoms, or 12 to 80 carbon atoms. The detergent can be derived from a detergent substrate which is normally an organic acid composition, or a reactive equivalent thereof such as an anhydride, having one or more acidic or reactive hydrogen atoms that is/are capable of reacting with a metal or metal reagent to form the overbased metal-containing detergent. The overbased metal-containing detergent will normally have more than 1 equivalent of metal per equivalent of detergent substrate. In several embodiments of the invention the overbased metal-containing detergent can have a ratio of metal to detergent substrate on an equivalent basis that is greater than 1, greater than 1 to 40:1, 2 to 40:1, 2.3 to 30:1, or 2.6 to 25:1. The detergent substrate can comprise an alkylarenesulfonic acid; a sulfur-coupled alkylphenol; an alkyl-substituted salicylic acid; a reaction product of an alkylphenol and formaldehyde where the reaction product is a methylene-coupled alkylphenol or a methylene-coupled alkylphenol having 2 or more groups selected from a formyl group, a hydroxymethyl group, or a mixture thereof; a reaction product of an alkylphenol and formaldehyde and a salicylic acid; an aliphatic monocarboxylic acid or polycarboxylic acid or reactive equivalent thereof such as for example an anhydride; or a mixture thereof. The detergent substrate in other embodiments can comprise an alkylarenesulfonic acid; a sulfur-coupled alkylphenol; an alkyl-substituted salicylic acid; a reaction product of an alkylphenol and formaldehyde where the reaction product is a methylene-coupled alkylphenol or a methylene-coupled alkylphenol having 2 or more groups selected from a formyl group, a hydroxymethyl group, or a mixture thereof; a reaction product of an alkylphenol and formaldehyde and a salicylic acid; or a mixture thereof. The overbased metal-containing detergent can be prepared by reacting a metal or metal reagent and a detergent substrate in the presence of an inert solvent and optionally a promoter. The metal reagent can comprise a basic inorganic metal compound to include a metal oxide or hydroxide or carbonate such as for example sodium hydroxide, calcium oxide, calcium hydroxide, magnesium oxide, and barium oxide. The inert solvent can be an aliphatic hydrocarbon, an aromatic hydrocarbon, a mineral oil, or a mixture thereof. The promoter can be a $C_1$ to $C_5$ carboxylic acid, a phenol, an alcohol, an inorganic metal salt such as a metal halide, or a mixture thereof. Overbased detergents, especially detergents having a metal to detergent substrate equivalent ratio greater than 1.1:1, are generally prepared as described above and also include in the reaction of the metal or metal reagent and detergent substrate an acidic material which is usually an inorganic acid such as for example carbon dioxide. The overbased detergents of this invention and their preparation are known to those skilled in the art, and the preparation of overbased detergents is disclosed in U.S. Pat. No. 3,488,284. The metal of the overbased metal-containing detergent can be present in the lubricant composition on a weight basis in several embodiments at 0.03 to 1.8%, at 0.04 to 1.35%, or at 0.06 to 0.9%.

Zinc Dialkyl Dithiophosphate

The lubricant composition of the invention as described throughout this application can further comprise (C) at least one zinc dialkyl dithiophosphate. Zinc dialkyl dithiophosphates can be derived from an alcohol, a phenol, or a mixture thereof. In an embodiment of the invention component (C) is derived from an alcohol. The alcohol can have 1 or more carbon atoms, and in other embodiments can be a $C_{1-10}$ alcohol, a $C_{2-9}$ alcohol, or a $C_{3-8}$ alcohol. The alcohol can be linear, branched, or a mixture thereof. The alcohol can be primary, secondary, tertiary, or a mixture thereof. In an embodiment of the invention the alcohol is primary $C_{3-8}$ alcohol, a secondary $C_{3-8}$ alcohol, or a mixture thereof such as for example 2 primary alcohols, 2 secondary alcohols, or a mixture of 1 primary alcohol and 1 secondary alcohol. In an embodiment of the invention the zinc dialkyl dithiophosphate can be derived from at least 50% on a mole basis or on a weight basis of at least one secondary alcohol, and in other embodiments the dithiophosphate can be derived from at least 70% or at least 90% on a mole or weight basis of at least one secondary alcohol. The zinc dialkyl dithiophosphate can be prepared by reacting phosphorus pentasulfide with a single alcohol or a mixture of alcohols usually in a mole ratio of alcohol per phosphorus atom that is greater than 2:1 to form the dithiophosphoric acid which can then be neutralized with zinc oxide. Zinc dialkyl dithiophosphates and their preparation are known to those skilled in the art, and U.S. Pat. No. 4,904,401 discloses the preparation of zinc dialkyl dithiophosphates. The zinc of the zinc dialkyl dithiophosphate can be present in the lubricant composition on a weight basis at 0.01 to 0.68%, at 0.017 to 0.5%, or at 0.026 to 0.34%.

The lubricant composition of the present invention can have on a weight basis a high sulfated ash content of greater than 1 to 2%, 1.3 to 1.95%, or 1.6 to 1.9%. In other embodiments of the invention the lubricant composition can have on a weight basis a low sulfated ash content of 0.1 to 1%, 0.2 to 0.9%, or 0.3 to 0.8%. The lubricant composition of the invention can have on a weight basis a high phosphorus content of 0.1% or greater or can have on a weight basis a low phosphorus content of less than 0.1%, less than 0.08%, or less than 0.06%. In an embodiment of the invention the lubricant composition has a low sulfated ash content as described above and a low phosphorus content as described above.

The method of the present invention can comprise a diesel engine that is equipped with an exhaust gas recirculation system.

Element-Containing Organic Composition

The lubricant composition of the present invention as described throughout this application can further comprise (D) at least one element-containing organic composition wherein the element is an element selected from a group 3 to group 15 element of the Periodic Table of the Elements or a mixture thereof. Component (D) can be an element-containing organic composition or a mixture of element-containing organic compositions. Component (D) can be oil soluble, oil dispersible, or soluble or dispersible in the lubricant composition. The element in the element-containing organic composition of component (D) can be bonded in an ionic bond, a covalent bond, complexed, or a combination thereof. Component (D) can be derived from any organic compound that is capable of bonding or complexing with a group 3 to group 15 element. The organic compound can have 1 or more carbon atoms, 1 to 100 carbon atoms, 1 to 90 carbon atoms, or 1 to 80 carbon atoms. The organic compound can have at least one heteroatom to include oxygen, sulfur, nitrogen, phosphorus, or a mixture thereof. Component (D) can be derived from organic compounds that comprise for example the detergent substrates described above in paragraph [0017], dialkyl dithiophosphoric acids as described above in paragraph [0018], a dithiocarbamate intermediate, a cyclic diene and carbon monoxide, and an alcohol or mixture of an alcohol and a hydroxy-containing glyceride. The element-containing organic compositions of component (D) and their preparation are known to those skilled in the art to include for example titanium alkoxides and complexes thereof; manganese complexes such as methylcyclopentadienyl manganese tricarbonyl; bismuth dithiocarbamates; a molybdenum dithiocarbamate as described in U.S. Pat. Nos. 4,846,983 and 6,777,378; an iron naphthenate salt; a copper naphthenate salt; a cobalt salt of a dialkyl dithiophosphoric acid as described above in paragraph [0018]; borate esters derived from reaction of 1 or 2 or 3 moles of alcohol per mole of boric acid as described in U.S. Pat. No. 6,777,378; and boron-containing overbased detergents as described in U.S. Pat. No. 4,744,920. In an embodiment of the invention the element of component (D) is an element selected from a group 4 element, a group 6 element, a group 7 element, a group 8 element, a group 9 element, a group 11 element, a group 13 element, a group 15 element, or a mixture thereof. In another embodiment of the invention the element of component (D) is titanium, manganese, iron, copper, or a mixture thereof. In several embodiments of the invention the element of component (D) can be present in the lubricant composition on a weight basis at 4 to 4000 ppm (parts per million), at 6 to 3000 ppm, or at 9 to 2000 ppm.

Other Additive

The lubricant composition of the invention as described throughout this application can further comprise (E) at least one other additive. The other additive or additives are known in the art and are commercially available or can be prepared by known methods. The other additive (E) can comprise a viscosity modifier, a pour point depressant, a detergent, a dispersant, an antiwear agent, an antioxidant, a corrosion inhibitor, a friction modifier, a foam inhibitor, or a mixture thereof. The viscosity index improver can comprise a polymeric composition to include a polymer or copolymer of an olefin having 1 or more double bonds, a styrene, an alkyl methacrylate ester, an alpha, beta unsaturated dicarboxylic compound, or a mixture thereof. Useful viscosity improvers can include an ethylene-propylene copolymer, a poly(methacrylate), a hydrogenated styrene-isoprene diblock copolymer, and a nitrogen containing esterified maleic anhydride-styrene copolymer. The pour point depressant can comprise an alkylated naphthalene, a phenolic oligomer from condensation of an alkylphenol and formaldehyde, a poly(methacrylate), a fumarate ester and/or maleate ester copolymer, an esterified and/or nitrogen containing esterified styrene-maleic anhydride copolymer, or a mixture thereof. The detergent can comprise a partially neutral or neutral metal-containing detergent as described above in paragraph [0017]. A partially neutral detergent will normally have less than 1 equivalent of metal per equivalent of detergent substrate while a neutral detergent will have an equivalent of metal per equivalent of detergent substrate. The dispersant can comprise a reaction product of a polyisobutenylsuccinic anhydride and a polyethylenepolyamine where the polyisobutenyl substituent is derived from a polyisobutylene having a number average molecular weight of 900 to 2500 and the ratio of succinic carbonyl to polyamine nitrogen is 1:1-2. The antiwear agent can comprise an organic sulfur compound to include a sulfurized olefin, a sulfurized fatty acid, a sulfurized fat or oil, a sulfurized olefin-containing carboxylic ester, or a mixture thereof. The antioxidant can comprise a hindered phenol or derivative thereof to include a base catalyzed reaction product of a hindered phenol and an alkyl acrylate ester, an organic sulfur compound as described above for the antiwear agent, a diarylamine to include an alkylated diphenylamine, or a mixture thereof. The friction modifier can comprise a fatty acid or derivative thereof to include a fatty acid, a fatty acid amide, a fatty acid ester, a fat or oil, or a mixture thereof. The corrosion inhibitor can comprise a carboxylic acid to include an alkenylsuccinic acid or anhydride and/or a fatty acid, an aryltriazole or derivative thereof, a dimercaptothiadiazole (DMTD) or derivative thereof to include an alkylthiolated DMTD, or a mixture thereof. The foam inhibitor can comprise an organic polymer to include one or more silicone oils, a poly(acrylate), or a mixture thereof. Each of the other additives of component (E) can be present in the lubricant composition on a weight basis at 0.001 to 15%, and in other instances at 0.001 to 12%orat0.01 to 9%.

Lubricant Composition Formulation

The lubricant composition of the present invention can be used to lubricate a diesel engine and can be formulated to comprise an oil of lubricating viscosity, at least one overbased detergent, and optionally one or more additives as disclosed and described throughout this application. In an embodiment of the invention the lubricant composition can be represented by a general formulation which is presented in the following table.

| |
|---|
| Base Stock Oil |
| Viscosity Modifier |
| Pour Point Depressant |
| Dispersant |
| Detergent |
| Antiwear Agent |
| Antioxidant |
| Corrosion Inhibitor |
| Friction Modifier |
| Foam Inhibitor |

In an embodiment of the invention the method of regenerating or improving the regeneration of the diesel particulate filter comprises reducing the ignition temperature of soot, reducing the maximum combustion temperature of soot, or a combination thereof. By reducing the ignition temperature or onset temperature at which soot combusts, a diesel particulate filter can be more readily regenerated and its regeneration is improved. By reducing the maximum or peak combustion temperature at which soot combusts, the regeneration of a diesel particulate filter is more controlled and improved because it avoids extreme temperatures due to the release of large amounts of heat in a short time period and thermal damage to the filter.

In an embodiment of the invention a method for improving the performance of a diesel particulate filter during the operation of a diesel engine comprises lubricating the engine with the lubricant composition as described throughout this application. The improvement in performance of a diesel particulate filter can comprise a) increasing the regeneration efficiency of the filter so that back pressure on the engine from soot buildup is reduced, b) increasing the life of the filter by reducing thermal stress from uncontrolled combustion of soot, or c) a combination thereof.

The following examples are provided to demonstrate the unexpected benefits of the methods of the present invention, but are not intended to limit the scope of the invention.

TGA Soot Combustion Evaluations

A Caterpillar™ 1P diesel engine is equipped with uncatalyzed cordierite particulate filters and an oil mist generator that introduces engine oil into the air intake manifold so that the effective consumption rate of engine oil, from combustion of engine oil entering the combustion chamber, is several multiples of the normal consumption rate of engine oil without an oil mist generator. The engine is run for 48 hours on each of four different high sulfated ash content (1.8 wt. % sulfated ash) heavy duty diesel engine oils. The four engine oils contain calcium detergents, calcium detergents and a borate ester, magnesium detergents, or magnesium detergents and a borate ester. A sample of the accumulated soot and ash in the particulate filters after the engine run for each of the four engine oils collected and compared to a commercial carbon black for combustion characteristics in a thermal gravimetric analysis (TGA) instrument.

| Example No. | Sample Identity | TGA Onset Temp, ° C.[f] | TGA Peak Temp, ° C.[f] |
|---|---|---|---|
| 1 (Comparative) | Carbon Black[a] | 505 | 642 |
| 2 | Ca[b] | 462 | 684 |
| 3 | Ca + B[c] | 455 | 661 |
| 4 | Mg[d] | 451 | 647 |
| 5 | Mg + B[e] | 449 | 658 |

[a]The carbon black is a commercial sample - Mogul L.

[b]The particulate filter sample comes from an engine run on a diesel engine oil containing calcium detergents.

[c]The particulate filter sample comes from an engine run on a diesel engine oil containing calcium detergents and a borate ester (0.1 wt. % B).

[d]The particulate filter sample comes from an engine run on a diesel engine oil containing magnesium detergents.

[e]The particulate filter sample comes from an engine run on a diesel engine oil containing magnesium detergents and a borate ester (0.08 wt. % B).

[f]A TA Instruments 2950 TGA equipped with a high resolution furnace is used to measure onset and peak temperatures which correspond respectively to the initial temperature and the maximum temperature at which combustion of the sample occurs.

Following the procedure described in paragraph [0026] above TGA peak or maximum temperatures for soot combustion are determined for 9 low sulfated ash content (0.5 to 0.7 wt. % sulfated ash) heavy duty diesel engine oils. All 9 engine oils contain calcium detergents while 8 of the engine oils also contain an element from group 3 to group 15 of the Periodic Table of the Elements.

| Example No. | Sample Identity | Grp 3-15 Element, ppm by wt | TGA Peak Temp, ° C. |
|---|---|---|---|
| 6 (comparative) | Carbon Black[1] | — | 642 |
| 7 | Ca[2] | — | 720 |
| 8 | Ca + B[3] | 637 | 702 |
| 9 | Ca + Co[4] | 131 | 664 |
| 10 | Ca + Fe[5] | 18 | 672 |
| 11 | Ca + Bi[6] | 203 | 607 |
| 12 | Ca + Cu[7] | 23 | 625 |
| 13 | Ca + Mo[8] | 138 | 600 |

-continued

| Example No. | Sample Identity | Grp 3-15 Element, ppm by wt | TGA Peak Temp, ° C. |
|---|---|---|---|
| 14 | Ca + Mn[9] | 27 | 672 |
| 15 | Ca + Ti[10] | 40 | 653 |

[1]The carbon black is a commercial sample - Mogul L.
[2]The filter sample comes from an engine run on an engine oil containing calcium detergents.
[3]The filter sample comes from an engine run on an engine oil containing calcium detergents and a borate ester.
[4]The filter sample comes from an engine run on an engine oil containing calcium detergents and a cobalt dialkyl dithiophosphate.
[5]The filter sample comes from an engine run on an engine oil containing calcium detergents and an iron naphthenate.
[6]The filter sample comes from an engine run on an engine oil containing calcium detergents and a bismuth dithiocarbamate.
[7]The filter sample comes from an engine run on an engine oil containing calcium detergents and a copper naphthenate.
[8]The filter sample comes from an engine run on an engine oil containing calcium detergents and a molybdenum-containing dithiocarbamate.
[9]The filter sample comes from an engine run on an engine oil containing calcium detergents and methylcyclopentadienyl manganese tricarbonyl.
[10]The filter sample comes from an engine run on an engine oil containing calcium detergents and a reaction product of titanium(IV) isopropoxide and glycerol monooleate.

Each of the documents referred to in this Detailed Description of the Invention section is incorporated herein by reference. All numerical quantities in this application used to describe or claim the present invention are understood to be modified by the word "about" except for the examples or where explicitly indicated otherwise. All chemical treatments or contents throughout this application regarding the present invention are understood to be as actives unless indicated otherwise even though solvents or diluents may be present.

What is claimed is:

1. A method for regenerating or improving the regeneration of a diesel particulate filter during the operation of a diesel engine, comprising:

lubricating the engine with a lubricant composition comprising (A) a major amount of an oil of lubricating viscosity;

(B) a minor amount of at least one overbased metal-containing detergent; and (C) at least one organic composition containing titanium;

wherein the detergent is derived from a detergent substrate; the metal of the detergent is an alkali metal, an alkaline earth metal, or a mixture thereof; and the overbased detergent has more than 1 equivalent of metal per equivalent of the detergent substrate; and wherein the detergent substrate comprises an alkylarenesulfonic acid, a sulfur-coupled alkylphenol, an alkyl-substituted salicylic acid, a reaction product of an alkylphenol and formaldehyde, a reaction product of an alkylphenol and formaldehyde and a salicylic acid, an aliphatic monocarboxylic acid or polycarboxylic acid or reactive equivalent thereof, or a mixture thereof;

wherein the regenerating or improving the regeneration of the diesel particulate filter comprises reducing the ignition temperature of soot, reducing the maximum combustion temperature of soot, or a combination thereof.

2. The method of claim 1 wherein the filter is an uncatalyzed filter or a catalyzed filter.

3. The method of claim 1 wherein the overbased detergent has 2 to 40 equivalents of metal per equivalent of detergent substrate.

4. The method of claim 3 wherein the lubricant composition further comprises (D) at least one zinc dialkyl dithiophosphate.

5. The method of claim 4 wherein the zinc dialkyl dithiophosphate is derived from at least 50 mole % of at least one secondary alcohol.

6. The method of claim 4 wherein the lubricant composition has on a weight basis a high sulfated ash content of greater than 1 to 2% or a low sulfated ash content of 0.1 to 1%.

7. The method of claim 6 wherein the metal of the detergent is an alkaline earth metal.

8. The method of claim 6 wherein the diesel engine is equipped with an exhaust gas recirculation system.

9. The method of claim 1 wherein the diesel engine is equipped with an exhaust gas recirculation system.

10. The method of claim 4 wherein the lubricant composition further comprises (E) at least one other additive.

11. A method for improving the performance of a diesel particulate filter during the operation of a diesel engine, comprising:

lubricating the engine with the lubricant composition of claim 1.

12. A method for regenerating or improving the regeneration of a diesel particulate filter during the operation of a diesel engine, comprising:

lubricating the engine with a lubricant composition comprising (A) a major amount of an oil of lubricating viscosity;

(B) a minor amount of at least one overbased metal-containing detergent; and (C) at least one organic composition containing titanium, bismuth, cobalt, or a mixture thereof wherein the detergent is derived from a detergent substrate; the metal of the detergent is an alkali metal, an alkaline earth metal, or a mixture thereof; and the overbased detergent has more than 1 equivalent of metal per equivalent of the detergent substrate;

wherein the detergent substrate comprises an alkylarenesulfonic acid, a sulfur-coupled alkylphenol, an alkyl-substituted salicylic acid, a reaction product of an alkylphenol and formaldehyde, a reaction product of an alkylphenol and formaldehyde and a salicylic acid, an aliphatic monocarboxylic acid or polycarboxylic acid or reactive equivalent thereof, or a mixture thereof; and wherein component (C) is selected from the group consisting of titanium alkoxides, bismuth dithiocarbamates, cobalt salts of dialkyl dithiophosphoric acids, or combinations thereof.

13. A method for regenerating or improving the regeneration of a diesel particulate filter during the operation of a diesel engine, comprising:

lubricating the engine with a lubricant composition comprising (A) a major amount of an oil of lubricating viscosity;

(B) a minor amount of at least one overbased metal-containing detergent;

wherein the detergent is derived from a detergent substrate; the metal of the detergent is an alkali metal, an alkaline earth metal, or a mixture thereof; and the overbased detergent has more than 1 equivalent of metal per equivalent of the detergent substrate; and wherein the detergent substrate comprises an alkylarenesulfonic acid, a sulfur-coupled alkylphenol, an alkyl-substituted salicylic acid, a reaction product of an alkylphenol and formaldehyde, a reaction product of an alkylphenol and formaldehyde and a salicylic acid, an aliphatic monocarboxylic acid or polycarboxylic acid or reactive equivalent thereof, or a mixture thereof; and (C) at least one organic composition containing bismuth, cobalt or a mixture thereof; wherein the regenerating or improving the regeneration of the diesel particulate filter comprises reducing the ignition temperature of soot, reducing the maximum combustion temperature of soot, or a combination thereof.

* * * * *